United States Patent [19]

Nordtvedt

[11] Patent Number: 4,595,074

[45] Date of Patent: Jun. 17, 1986

[54] STOCKING-LIKE ESCAPE DEVICE

[75] Inventor: Svein Nordtvedt, Godvik, Norway

[73] Assignee: Bergen Patentkontor, Bergen, Norway

[21] Appl. No.: 638,470

[22] PCT Filed: Dec. 30, 1982

[86] PCT No.: PCT/NO82/00061

§ 371 Date: Aug. 1, 1984

§ 102(e) Date: Aug. 1, 1984

[87] PCT Pub. No.: WO84/02658

PCT Pub. Date: Jul. 19, 1984

[51] Int. Cl.[4] ..... A62B 1/20

[52] U.S. Cl. ..... 182/48

[58] Field of Search ..... 182/48, 49, 47; 193/25 R, 25 B, 27, 25 A

[56] References Cited

U.S. PATENT DOCUMENTS

| | | | |
|---|---|---|---|
| 99,399 | 2/1870 | Burditt | 193/25 R |
| 391,051 | 10/1888 | Jones | 182/48 |
| 1,339,338 | 5/1920 | Hickok | 182/49 |
| 2,690,827 | 10/1954 | Wiggins | 193/25 R |
| 3,428,156 | 2/1969 | Charyn | 193/25 R |
| 3,994,366 | 11/1976 | Okuma | 182/48 |
| 4,099,595 | 7/1978 | Tracy | 182/48 |
| 4,240,520 | 12/1980 | LaGrone | 182/47 |

FOREIGN PATENT DOCUMENTS

| | | | |
|---|---|---|---|
| 1434366 | 5/1976 | United Kingdom | 182/49 |
| 1464052 | 2/1977 | United Kingdom . | |

*Primary Examiner*—Reinaldo P. Machado
*Assistant Examiner*—Alvin Chin-Shue
*Attorney, Agent, or Firm*—Kenyon & Kenyon

[57] ABSTRACT

Stocking-like escape device comprising a stocking of canvas material or similar material. The stocking which preferably is made of netting permitting the through passage of wind, is with axial intervals provided with an annular reinforcing element for stretching out the stocking. The stocking is connected to two or more axially extending lines which are connected to the reinforcing elements and preferably to each reinforcing element on diametrically opposite sides thereof.

6 Claims, 4 Drawing Figures

FIG1
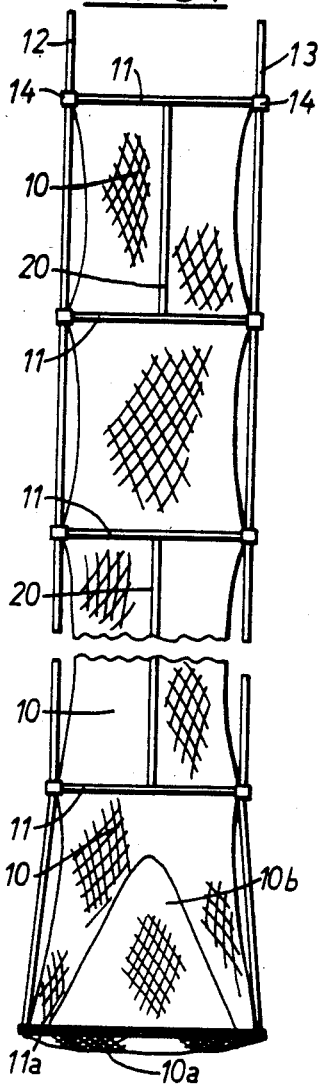
FIG2
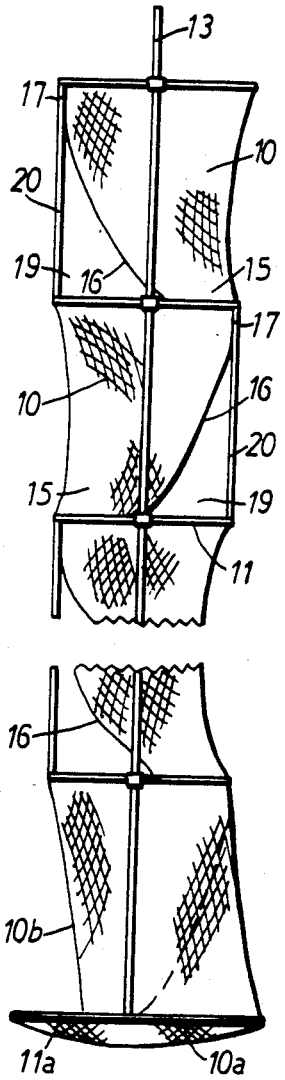
FIG3
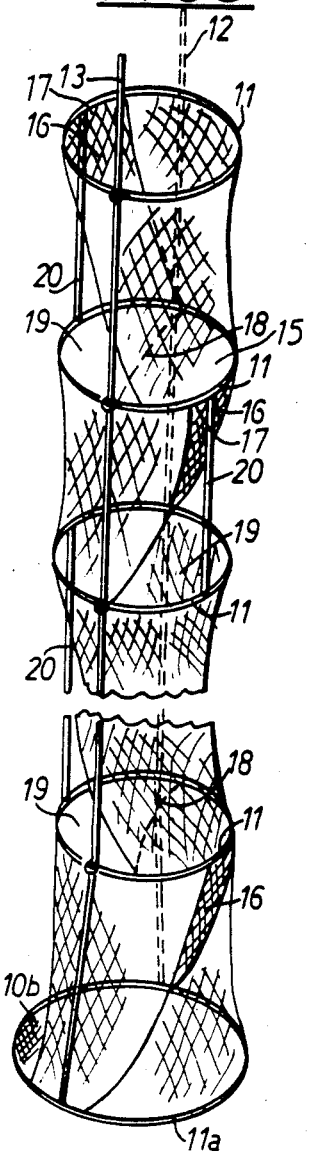
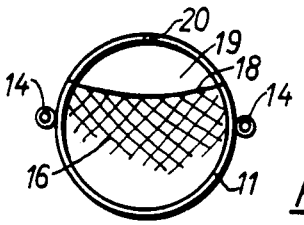
FIG.4

STOCKING-LIKE ESCAPE DEVICE

The present invention relates to a stocking-like escape device.

Stocking-like escape devices have been tried in connection with an escape from bore platforms and other installations in the North Sea, where the escape device has been stretched out from the platform to a ship lying below. Such stocking-like escape devices made of relatively closely woven, stretch-strong canvas material have been tried, but it has proved difficult especially in strong winds to maintain the device in position in a functionally efficient condition due to the large wind trap formed with such a relatively closely woven canvas material and the tendency for local twisting together of the canvas material and following from this a choking together of the internal passage. It has also been found difficult to have several persons conveyed in a controlled manner through the device at the same time successively one after the other.

In the stocking which is known from U.S. Pat. No. 1,116,189 use has been made of braking means in the form are made of elastic rings which are connected to each other by way of a series of mutually spaced apart support chains. In order to avoid injury to the person who undertakes the escape through the escape device the person is picked up in a bag-shaped enclosure. However, it is a danger that heavy persons may be shot at a quick speed downwards through the escape device, whereas light persons may have a substantially slower speed and may possibly be stuck locally in the escape device. It is also a small possibility for the person who is picked up in the bag-shaped enclosure to affect the escape course. It cannot be precluded that the person and the enclosure during the passage through the escape device under certain circumstances, instead of passing through the opening in the elastic ring, pass through one of the openings between the chains and, unhindered, out of the escape device.

In DE-Auslegeschrift it is shown an enclosure 11 to pick up a person who is to undertake an escape. In a similar manner as by the above-mentioned, known solution a light person will have difficulties in getting a sufficient escape speed, whereas a heavier person may have problems with a too quick speed, as one is quite dependent on the elasticity of the stocking.

With the present invention a solution is aimed for where the afore-mentioned problems can be avoided in a relatively simple manner.

Briefly, the invention provides an escape device comprising a tubular member such as a stocking, a plurality of annular reinforcing members which are spaced longitudinally of the tubular member, longitudinally extending support ropes connected with the reinforcing members and means for braking the speed of passage of a person passing through the tubular member. Each braking means extends obliquely downwards between a pair of reinforcing members to form one side portion of the tubular member while defining an access opening to the tubular member with a lower one of the pair of reinforcing members.

The tubular member is made of at least partially elastically yielding material such as netting material.

By using netting instead of the previously tried, relatively airtight canvas material, several advantages are obtained. Firstly, the trapping of wind in the device can be greatly reduced by allowing passage of the wind through the netting material in the device. Secondly, the collection of smoke internally in the device can be prevented. Thirdly, there is the possibility of forming a finger hold or possibly a foot hold where there would be a need for this, as a result of the mesh formation in the netting material, but, nevertheless, there is the possibility for ready sliding of persons along the netting material in the longitudinal direction of the device.

By utilising annular reinforcing elements suitably spaced in the longitudinal direction of the device, there is firstly the possibility of preventing folding and whirling together of the wall material (the netting) of the device, so that a through, open passage through the device can be guaranteed. Secondly, there is the possibility of forming local stop locations in the passage through the stocking by means of the reinforcing elements, so that the evacuation can be effected in a controlled manner. Thirdly, the reinforcing elements can counteract stretching out to the full length of the meshes of the netting and instead provide significant elasticity in the netting material between the reinforcing elements.

By, in addition, connecting the reinforcing elements to each other via two or more axially extending lines on the diametrically opposite sides of the reinforcing element, there is the further possibility of preventing twisting together of the stocking and any tendency for turning of the stocking, since the course of the stocking can be regulated by exerting a controllable tension in the lines in addition to the tension which is exerted in the stocking itself.

The device according to the invention is characterized in that the braking means consist of at least partially elastically yielding material, such as netting material permitting the through passage of wind, and pass obliquely downwards between pairs of reinforcing elements from the one side portion on the upper reinforcing element of the pair towards the opposite side portion on the lower reinforcing element of the pair, preferably from the one side to the opposite side of a plane through the lines.

With the aid of the lines the device can be hauled upwards in a tight, closely packed condition into a storage housing adapted for this purpose, when the device is out of use. When the device is to be used, it can be made ready in an easy manner by paying out the lines, the stocking being adjustable automatically into the correct use position with associated reinforcing elements by means of the weight loading in these elements, or by means of extra weight-producing means in connection with the reinforcing elements or in connection with the lower reinforcing element.

According to the invention it is obtained an especially controlled conveyance or controlled passage of persons with or without baggage through the stocking.

Instead of slipping downwards through the stocking, the present invention enables a controlled sliding movement from reinforcing element to reinforcing element to be effected. It also provides the possibility for auxiliary personnel to bring along an injured or sick person in a controlled manner in said zig-zag path through the stocking from reinforcing element to reinforcing element.

Furthermore, it is preferred that the braking means form the one side portion of the stocking in a local region between each pair of reinforcing elements, the braking means passing obliquely downwards from the upper of the pair of reinforcing elements to a fastening at the transition between opposite side portions in the lower of the pair of reinforcing elements, while it is defined an entrance opening to the stocking between the lower reinforcing elements of the pair and the outwardly directed side of the braking means.

In this way, there can be produced a device having a series of successive laterally directed (upwardly opening) openings for entrance at various height levels (different floors) to the escape stocking. Such entrance openings can obviously also be employed, where needed, as exit openings, for example, where a person for one or another reason has blocked the passage and subsequent persons have to pass by the person concerned a little externally of the escape stocking.

Further features of the solution according to the invention will appear from the following description with reference to the accompanying drawings, in which:

FIGS. 1 and 2 show sections of the device according to the invention, shown in front and from the side, respectively.

FIG. 3 shows the same as in FIGS. 1 and 2 in perspective.

FIG. 4 shows a cross-section of the device.

In the drawing it is shown a section of a device which is suspended to hang vertically downwards and which, for example, can be used an an escape device in connection with a multi-storied house. However, the device can also be suspended to hang obliquely downwards, for example, when used as an escape device in connection with evacuation from oil platforms and ships and similar vessels at sea.

The device of the present invention is illustrated in an especially simple form in the shown embodiment, as it is constructed of a stocking or chute 10 of netting which is locally reinforced by annular reinforcing elements or members 11 which are arranged at spaced apart at intervals of, for example, 2 to 3 meters along the length of the stocking. The reinforcing elements 11 can be roped or fastened in another way to the netting material so that there is obtained a relatively uniform distribution of the meshes of the netting along the reinforcing element and thereby a correspondingly uniform distribution of the meshes in the peripheral direction of the stocking. With tension in the longitudinal direction of the stocking, the meshes will be held stretched out to the intended mesh size, controlled by the reinforcing element, the mesh blocks assuming the customary oblique, downwardly extending zig-zag form with substantially "spekelasje" shaped meshes.

In the shown embodiment, the reinforcing elements 11 are connected to each other, outside the stocking 10, via a pair of diametrically opposed lines 12, 13 which pass through their respective fastening rings 14 on each individual reinforcing element 11. At the lower end of the device, however, the lines are fastened to the reinforcing element 11*a* firmly secured to the latter so that the reinforcing element 11*a* is supported by the lines 12, 13. Lowermost there is shown a bottom 10*a* of netting material together with a laterally directed opening 10*b* in the netting material of the stocking.

Alternatively, more than two such lines 12, 13 can be employed, for example three or four lines with equally large distances between the fastening points on the reinforcing elements.

The material of the stocking 10 and of the lines 12, 13 can consist of synthetic fibres, natural fibres or mixtures thereof. Preferably it is used flame-proof material, that is to say material which is provided with flame-proof fibres or where the fibres have been made flame-proof. It is especially of current interest to use so-called aromatic polyamide fibres or so-called aramide fibres.

In addition to the shown device of stocking 10, reinforcing elements 11 and lines 12, 13, it can be of current interest to use special heat shields of incombustible material, for example in the form of canvas material or fine-meshed netting material made of aromatic polyamide fibres.

In the shown embodiment, circular reinforcing elements are employed, for example, of rigid pipe-shaped material, but it will also be possible to utilise elliptical or multi-sided reinforcing elements where this has to be preferred.

As shown in FIGS. 2 and 3, there is formed a zig-zag shaped passage 15 through the stocking 10, with the aid of pieces 16 of netting which extend obliquely downwards and inwards into the stocking 10 from a local side portion 17 of an upper reinforcing element to a line 18 which passes across a lower reinforcing element approximately at its transverse center line. The line 18 is fixed by an elastic band of rubber or another suitable material which is threaded through the lower meshes of the netting piece 16. In the shown embodiment (see FIG. 4), the band 18 is fastened to the reinforcing element 11 at a certain distance from the fastening rings 14 on the reinforcing element and is then preferably secured immovably to special fastening points on the reinforcing element. Alternatively, the band 18 can be fastened directly to the fastening rings 14. As a consequence of the elasticity in the band 18 and the elasticity in the netting piece 16 there can be obtained at the upper and central portions of the netting piece 16 a certain bag formation which can brake the passage through the stocking 10, while the elasticity of the band 18 permits relatively unhindered further passage at the other end of the netting piece.

As a consequence of the securement of the netting piece 16 in the obliquely downwardly directed path, with fastening approximately at the transverse center line of the reinforcing element, there can be obtained a certain swinging of the reinforcing element about the center line through the fastening rings 14, something which contributes to the said bag formation in the upper and central portions of the netting piece on loading from a person passing by.

Another effect of the securement of the netting pieces 16 in the manner shown between each pair of reinforcing elements is that there are formed upwardly opening access openings 19 to the interior of the bag on the outer side and the under side of the netting piece 16. In this way, there is the possibility for access (entrance or exit) to and from the interior of the stocking at various levels, in the length (height) direction of the stocking. As a result, the possibility exists of getting access to the stocking from different floors in a connected house which is to be evacuated or from different decks on a platform or the like which is to be evacuated.

Instead of using netting material in the pieces 16, there can be utilised smoother, more slide-prone material, for example, plastic-impregnated or plastic-coated canvas material or fine-meshed netting, the netting material (large meshes) in the stocking remaining together with said openings 19 being able, in the intended matter, to create sufficient air flow through the stocking. In cases where the flow through of strong wind is of less significance, there can be used instead of the netting material an arbitrary other material (canvas material and the like). Especially for strength considerations, but also for other reasons, there are inserted tension-absorbing line members 20 in the height direction across the openings 19.

Obviously, it will also be possible to employ separately produced pices 16 (of arbitrary material) in the manner shown in the drawing, while the remainder of the stocking extends continuously outside the said openings 19. If necessary, the openings 19 can be formed only at individual reinforcing elements and not at every single reinforcing element.

It is also possible to use extra bag-forming pieces (not shown) just below the said openings 19 so that the person who enters through the opening (or goes out through the opening) can find a foothold for further passage past the opening.

In the inactive condition, the device of the present invention can be packed together in a compact manner requiring little space in a building (not shown) suitable for the purpose at the upper end of the device, by hoisting the lines 12, 13, the material of the stocking being folded together internally into the reinforcing elements which are pushed tightly together guided via the fastening rings 14.

On setting out the device, the lines 12 and 13 can be correspondingly let out whereby the stocking 10 with associated reinforcing elements 11 will thereby assume by itself, as a result of its own weight and possibly extra weight loading, for example, in the reinforcing elements, the intended, stretched-out stocking shape as shown in FIG. 3.

In the shown embodiment, the lines 12, 13 pass outside the stocking via the fastening rings 14. If desired, the lines can pass internally in the stocking 10, fastened to the fastening rings 14, or with the lines threaded through certain or all of the height succeeding meshes between each pair of reinforcing elements.

I claim:

1. A chute forming escape device comprising a tubular member of at least partially elastically yielding material capable of permitting the through passage of wind therethrough;

a plurality of annular reinforcing members spaced longitudinally of said tubular member;

longitudinally extending support ropes connected with said reinforcing members; and means for braking the speed of passage of a person passing through said tubular member, each braking means being secured to and extending obliquely downwards between a pair of reinforcing members to form one side portion of said tubular member while extending transversley of a lower one of said pair of reinforcing members to define an access opening to said tubular member.

2. A chute-forming escape device as set forth in claim 1 wherein each braking means has an elastically yielding fastening means at a lower edge secured to said lower one of said reinforcing members for stretching said braking means across a central portion of said tubular member.

3. A chute-forming escape device as set forth in claim 1 wherein said braking means form a zig-zag path between said reinforcing members longitudinally of said tubular member.

4. An escape device comprising a stocking to be suspended in a downward manner;

a plurality of annular reinforcing elements arranged at spaced apart intervals along the length of said stocking;

at least one pair of diametrically opposed lines secured to said reinforcing elements for suspending said stocking, and a plurality of pieces defining a zig-zag shaped passage through said stocking, each said piece being connected to and extending obliquely downwards and inwards into said stocking from an upper reinforcing element to a transverse center line of a lower reinforcing element and defining an access opening to the interior of said stocking.

5. An escape device as set forth in claim 4 wherein said stocking is made of a netting material.

6. An escape device as set forth in claim 4 wherein said stocking is foldable into said reinforcing elements in a compact manner.

* * * * *

UNITED STATES PATENT AND TRADEMARK OFFICE

CERTIFICATE OF CORRECTION

PATENT NO. : 4,595,074

DATED : June 17, 1986

INVENTOR(S) : SVEIN NORDTVEDT

It is certified that error appears in the above-identified patent and that said Letters Patent is hereby corrected as shown below:

Column 1, line 24 change "form are made of" to -form of-

Column 1, line 68 change "passage of the" to -the passage of-

Signed and Sealed this

Thirtieth Day of December, 1986

*Attest:*

DONALD J. QUIGG

*Attesting Officer*

*Commissioner of Patents and Trademarks*